United States Patent [19]

Maisonneuve

[11] Patent Number: 5,012,731

[45] Date of Patent: May 7, 1991

[54] DEVICE FOR PRESSING HETEROGENEOUS MIXTURES WITH REGULATED PRESSING FORCE FOR SEPARATING LIQUID AND SOLID FRACTIONS THEREOF, IN PARTICULAR FRUIT JUICES

[76] Inventor: Yves Maisonneuve, L'Habit, Echallat (Charente), France, 16170

[21] Appl. No.: 447,031

[22] Filed: Jul. 27, 1989

Related U.S. Application Data

[63] Continuation-in-part of Ser. No. 273,712, Nov. 17, 1988, abandoned, which is a continuation of Ser. No. 139,107, Dec. 22, 1987, abandoned, which is a continuation of Ser. No. 877,307, Jun. 23, 1986, abandoned.

[30] Foreign Application Priority Data

| | | | |
|---|---|---|---|
| Jun. 26, 1985 | [FR] | France | 85 9689 |
| Oct. 23, 1985 | [FR] | France | 85 15712 |
| Dec. 2, 1985 | [FR] | France | 85 17905 |

[51] Int. Cl.[5] ..... B30B 9/06

[52] U.S. Cl. ..... 100/110; 100/116; 100/126; 100/127; 100/129; 100/148; 100/150

[58] Field of Search ..... 100/110, 116, 117, 126–129, 100/145–150, 111, 106, 191, 192

[56] References Cited

U.S. PATENT DOCUMENTS

| | | | |
|---|---|---|---|
| 863,885 | 8/1907 | Schneider et al. | 100/127 X |
| 1,421,282 | 6/1922 | Meakin | 100/150 X |
| 1,765,389 | 6/1930 | Wendler | 100/117 X |
| 1,851,191 | 3/1932 | Lang | 100/148 X |
| 2,055,697 | 9/1936 | Molin | 100/129 X |
| 3,126,818 | 3/1964 | Koelsch | 100/150 X |
| 3,520,411 | 7/1970 | Busse et al. | 100/192 X |
| 3,555,999 | 1/1971 | Glowacki | 100/148 |
| 4,003,304 | 1/1977 | Reinhall | 100/148 X |
| 4,119,025 | 10/1978 | Brown | 100/116 X |
| 4,412,485 | 11/1983 | Brown | 100/127 X |
| 4,709,628 | 12/1987 | Glowacki | 100/148 |

FOREIGN PATENT DOCUMENTS

| | | | |
|---|---|---|---|
| 2620628 | 3/1977 | Fed. Rep. of Germany | 100/117 |
| 751551 | 6/1933 | France | 100/117 |
| 1275477 | 10/1961 | France | 100/117 |
| 2263884 | 10/1975 | France . | |
| 2522585 | 9/1983 | France . | |
| 2543487 | 10/1984 | France . | |
| 52-18262 | 2/1977 | Japan | 100/116 |
| 33578 | 11/1921 | Norway | 100/127 |
| 61628 | 11/1912 | Switzerland | 100/110 |
| 149782 | 12/1931 | Switzerland | 100/106 |
| 1096130 | 6/1984 | U.S.S.R. | 100/117 |
| 1170315 | 11/1969 | United Kingdom | 100/192 |
| 1506455 | 4/1978 | United Kingdom | 100/148 |
| 85/04837 | 11/1985 | World Int. Prop. O. | 100/117 |

*Primary Examiner*—Robert W. Jenkins
*Assistant Examiner*—Stephen F. Gerrity
*Attorney, Agent, or Firm*—Fleit, Jacobson, Cohn, Price, Holman & Stern

[57] ABSTRACT

An apparatus for separating, by pressing, liquid and solid fractions intimately associated in a heterogeneous mixture, such as for example juices, pulps, stones, pits, pips, stalks and vegetable elements of fruits such as wine grapes is characterized in that a vessel (14) is provided having perforate side walls (15, 16) and bounded on its open upstream end by a piston-like member (10, 11) and on its open downstream end by a conical outlet member (50) defining an annular outlet passage, the vessel being filled with the heterogeneous mixture in an upstream-downstream direction thereof, and the vessel then being moved (30, 31) in the opposite, downstream-upstream direction so that the heterogeneous mixture is compressed between the piston-like member (10, 11) and the conical member (50), the pressing force being regulated and modulated for preventing deleterious over-pressing.

26 Claims, 8 Drawing Sheets

DEVICE FOR PRESSING HETEROGENEOUS MIXTURES WITH REGULATED PRESSING FORCE FOR SEPARATING LIQUID AND SOLID FRACTIONS THEREOF, IN PARTICULAR FRUIT JUICES

This is a continuation-in-part of prior application Ser. No. 07/273,712 filed Nov. 17, 1988, (now abandoned) which in turn was a continuation of prior application Ser. No. 07/139,107 filed Dec. 22, 1987, (now abandoned), which in turn was a continuation of prior application Ser. No. 06/877,307 filed June 23, 1986, (now abandoned) and the contents of which are expressly incorporated herein by reference thereto.

BACKGROUND OF THE INVENTION

1. Field of the Invention

Presses particularly suitable for the extraction of fruit juices and comprising a vessel which has perforated walls, and into which the material to be pressed is introduced for compression by means of a worm, have been known for a very long time. There are numerous variants of this general principle, particularly in respect of the form of the central shaft worm and the shape of the compression vessel itself. Whatever these variants, all presses of this type have the major disadvantage that the material to be pressed is triturated between the periphery of the central worm and the perforated walls of the vessel, because friction unavoidably occurs against the turns (i.e. vanes) of the worm and against the perforated walls, which act like a grater.

These disadvantages are very serious, as they entail the fragmentation of solid material and the crushing of pips or herbaceous pieces, thus giving rise to the release of oil producing a bitter taste and giving the extracted juice an astringency incompatible with good quality.

2. Description of the Related Art

French patent application FR-A-74/09591 (published under No. 2,263,884) describes a juicing press having a compression vessel (i.e. a so-called "pressing vessel") whose walls are perforated and which has a cylindrical shape, and also having a central helicoidal screw which itself is cylindrical but whose central shaft has a plurality of parts of different conicities.

French patent application FR-A-82/03408 (published under No. 2,522,585) describes a press having a first cylindrical part, a second frustoconical part, and an axial helicoidal screw whose turns are themselves cylindrical on a likewise cylindrical hub.

French patent application FR-A-83/05068 (published under No. 2,543,487) describes a press having a compression vessel comprising a first cylindrical part, a second frustoconical part connected to the first part, and a third, likewise cylindrical part connected to the frustoconical part, while the helicoidal screw again has a cylindrical contour.

It will be seen that in all cases the pressure exerted on the material is generated by the rotating helicoidal screw, which is the source of the disadvantages described above, the seriousness of which is such that the use of presses of this type for producing grape juice intended for making cognac has been banned.

The idea was then conceived of eliminating trituration by making harmless the helicoidal conveyor screw turning in the axis of the compression vessel. For this purpose the helicoidal screw is mounted for axial movement as well as for rotation in the direction applying a thrust (i.e. imparting pressing) to the material. When this screw encounters a predetermined resistance, it retracts to a starting position and then, on cessation of the rotation, the screw is pushed, without turning, against the material already pressed, while fresh material to be pressed is introduced and the screw is retracted while turning it in the opposite direction to the thrust, so that it is "unscrewed" in the fresh material, whereupon the cycle is repeated.

This arrangement provides an improvement over previous presses, but still has a considerable disadvantage, because the pressure is exerted in the same direction as the introduction of the material, that is to say in a so-called "upstream-downstream" direction, while in addition this pressure is predominant in the center of the vessel, the necessary back pressure being obtained by means of a gate disposed across the end of the vessel opposite to that where the material to be pressed enters.

For the record, mention may be made of the press which has a compression vessel containing two helicoidal screws having inverse pitches, on each of which is fixed a plate having the same section as the vessel and serving as a nut when the vessel is turned with the screws held fixed, because the plates move towards one another to press the material placed between them, or move apart to free the material, depending on the direction in which the compression vessel is driven.

A press of this kind, which has been known for many years, also has a very poor output because the time required for a pressing operation is three and one-half hours and this period of time gives rise to the oxidation of the tannin and of all oxidizable substances, including those imparting aroma, the whole operation resulting in a flat, tasteless and odorless juice when the material pressed consists of wine grapes.

In this connection, it has consequently been found that pressing a heterogenous mixture is a difficult operation if it is desired to obtain a good yield, that is to say the extraction of at least eighty per cent of liquid fraction with twenty per cent of solid fraction, while obtaining a good quality at an economic price.

SUMMARY OF THE INVENTION

The present invention provides a solution constituting a considerable improvement, because it provides for the presence of a conical shield which permits an elevated pressure at the outlet of a pressing vessel, the shield being movable relative to a fixed piston. In this way an arrangement is obtained which avoids any detrimental action on the mixture to be pressed, and which gives an excellent yield.

Furthermore, the present invention provides a means of improving the distribution of working pressure in the vessel by using different structural variants for the construction of the means generating this pressure.

To this end, the invention relates to a process for separating, by pressing, liquid and solid fractions intimately associated in a heterogeneous mixture, such as for example juices, pulps, stones (i.e. pits), pips, stalks, and vegetable elements of fruits such as wine grapes, characterized in that a vessel having side walls pierced with fine passages is filled, in a direction called the "upstream-downstream" direction, from an end of the vessel called the "inlet" end, with the heterogeneous mixture. The introduction of the mixture is then interrupted, and pressing is effected by bringing about on the one hand a relative linear movement between the vessel and a non-rotating part thereof forming a piston and situated in front of the inlet end, so that this part penetrates from upstream to downstream into the vessel, and on the other hand an opposing retaining force, i.e. a force acting in the "downstream-upstream" direction, coaxially to the vessel, at the end of the latter known as the "outlet" end, (i.e. the end opposite to the previously mentioned "inlet" end), while providing a likewise coaxial, annular outlet space for the solid fractions separated from the liquid fractions during the pressing and thus agglomerated. Then, after the pressing of the heterogeneous mixture is performed, which simultaneously causes the discharging of at least a part of the liquid fractions through the walls of the vessel and the discharging of a part of the solid fractions through the outlet space, the relative linear movement is halted, and thereupon the introduction of the mixture and its pressing in the vessel are resumed with a pressure coordinated with the value of the outlet retaining force, and so on.

According to other characteristics of this process, in order to effect the pressing, the vessel may be held motionless and the part forming a piston may be moved in the upstream-downstream direction in an axial sliding movement relative to the vessel. Also, the pressure in the vessel and the opposing retaining force are coordinated to establish a pressure in the vessel which pressure slightly increases from the inlet end to a zone situated near the outlet end, starting from which zone a distinct increase of the retaining force is brought about.

The invention also relates to an apparatus for applying this process, which apparatus is characterized in that it comprises on the one hand a vessel whose side walls are pierced with fine passages and which has two opposite open ends, the one end known as the "inlet" end being situated facing a part forming a piston and being provided with an opening for the admission of the mixture into the vessel, and on the other hand a shield associated with the other so-called "outlet" end of the vessel, the assembly comprising the vessel and the shield being mounted for movement relative to the part forming a piston, for the purpose of pressing the material between the shield and the part forming a piston, with the liquid fractions having to pass through the vessel by way of fine passages while the solid fractions have to be discharged around the shield.

According to other characteristics of this apparatus:

The shield may be mounted to be elastically movable in the longitudinal direction of the vessel, in order to leave a larger or smaller coaxial annular passage for the discharge of the solid fractions, means being provided for effecting a relative linear movement between the vessel and the part forming a piston.

The part forming a piston may be composed of a front wall of a hollow sleeve which is situated at the end of a tank provided with a hopper for the introduction of the heterogeneous mixture and which is associated with a rotating axial screw situated facing an opening passing through the center of the front wall of the sleeve, this screw being shaped to form at its end at least one part substantially at right angles to the axis of the screw.

The part forming a piston may be mounted for movement, while the vessel is stationary.

The part forming a piston may be composed of at least one independent screwthread which is connected kinematically to two separate mechanisms adapted to drive it alone, for rotation and for axial translation, respectively, and the end of the screw is shaped to form at least one part substantially at right angles to its axis.

The stem of the screw may be hollow and through it may pass freely a shaft carrying a screwthread, which is thus in line with the screw, this shaft being connected to mechanisms adapted to drive it for rotation and for axial translation, respectively, independently of the stem of the screw.

The front wall may have a central opening provided with a non-return valve.

The vessel and/or the shield may have deformable profiles. The profile of the vessel may be deformable, having at least one inflexion point. The profile of the shield may be deformable, having at least one inflexion point. These deformable profiles may be adapted to form either convex or concave portions.

The apparatus may include a brake mechanism disposed at the outlet of the vessel. The brake mechanism may consist of a skirt placed in line with the vessel. The brake mechanism may include at least one rotationally movable annular part associated with means adapted to drive it, preferably at an adjustable speed.

The annular part may comprise a crown fastened to at least one internal member of helicoidal form having at least one turn, the direction of rotation and the pitch of the helicoidal member being adapted for the discharge of solid fractions and not for their compression.

The annular part may comprise a crown fastened to internal helicoidal fins or blades.

The vessel may be associated, on its axis, with a solid fraction evacuator in the form of a screw whose diameter advantageously increases in the upstream-downstream direction, means being provided for bringing about a relative rotational movement between the vessel and the screw.

The outer edge of the screw may preferably be sharp.

The vessel may have internal longitudinal ribs.

The shield may be of the filtering type, i.e., pierced with holes for the passage of liquid fractions.

The section of the vessel and that of the shield may be either circular or polygonal.

BRIEF DESCRIPTION OF THE DRAWINGS

The invention will be better understood from the detailed description given below with reference to the accompanying drawings. The description and the drawings are given only as indicative and non-limitative examples.

DETAILED DESCRIPTION OF THE INVENTION

Figure 1:
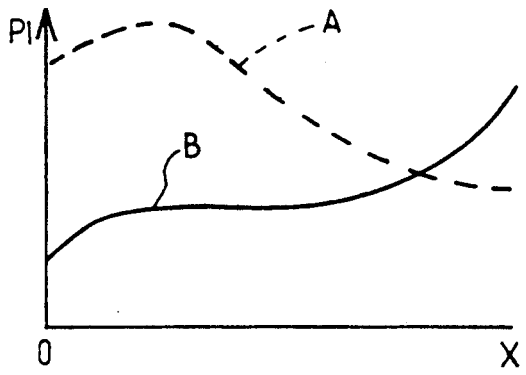
FIG.1 (PRIOR ART)
FIG. 1 is a graph showing how the pressure acting on a mixture to be pressed, considered longitudinally, is distributed, according to the prior art and according to the invention, respectively.

Referring to FIG. 1, it can be seen how the pressure P1 varies due to forces generated by various known mechanisms and acting on a mixture to be pressed in a vessel in the "upstream-downstream" direction of a pressing apparatus, that is, longitudinally from the inlet 0 to the outlet X of the apparatus.

The curve A shows this variation in a known apparatus: the pressure is first established at the inlet 0 at a high value and then increases still further and then decreases regularly towards the outlet X, where it is minimal.

The curve B shows the variation of this same pressure Pl in the process according to the invention, and it can be seen that at the inlet 0 the pressure Pl is established at a relatively low value, then increases regularly but only slightly, thus remaining practically uniform as far as the vicinity of the outlet X, where it increases substantially until it attains its maximum value.

Comparison of these two curves shows that the distribution of the pressure Pl, considered longitudinally, is practically the inverse in an apparatus of the known type in comparison with the process of the invention, since the maximum in curve A is situated close to the inlet 0 and its minimum is situated at the outlet X, whereas in curve B it can be seen that the pressure P1 has a minimum value at the inlet 0 and a maximum value at the outlet X.

Figure 2:
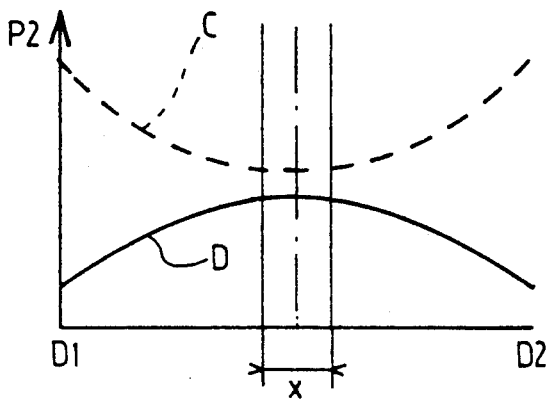
FIG.2 (PRIOR ART)
FIG. 2 is a graph showing how this same pressure, considered transversely, is distributed, according to the prior art and according to the invention, respectively.

In FIG. 2 it can be seen how the pressure P2, considered this time transversely in relation to a pressing apparatus, is distributed. D1 indicates one end of a diameter of this apparatus, and D2 the opposite end of the same diameter.

The curve C shows the distribution of the pressure P2 in an apparatus of known type, and it can be seen that the pressure is maximal on the periphery, while it is minimal in the central part x. The curve D shows the distribution of the transverse pressure P2 in the process according to the invention, and it can be seen that this curve D is exactly the inverse of curve C, since the pressure P2 has minimum values on the periphery of the apparatus and maximum values in the central part x.

Figure 3:
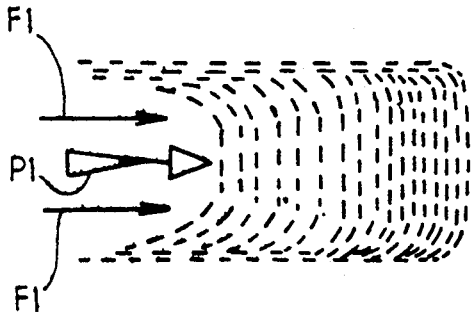
FIG.3 (PRIOR ART)
FIG. 3 shows schematically how the solid fractions are orientated during the pressing.

FIG. 3 shows the effects, in a known apparatus, of the pressure P1 indicated by an arrow, and it can be seen that this pressure P1 is exerted from the inlet to the outlet, that is, in the "upstream-downstream" direction and in the same direction as the admission of the mixture to be pressed, which is represented by two arrows F1.

The general orientation of solid elements has also been shown, these elements being, in the course of the pressing operation, oriented at right angles to the pressure P1 in the central part of the apparatus, while they progressively become inclined towards the periphery, where they are practically directed parallel to the direction of the pressure P1, i.e., at right angles to the radial passages of the pressing apparatus, this orientation having the effect that they positively close the openings in the walls and prevent the passage of the liquid fractions.

Figure 4:
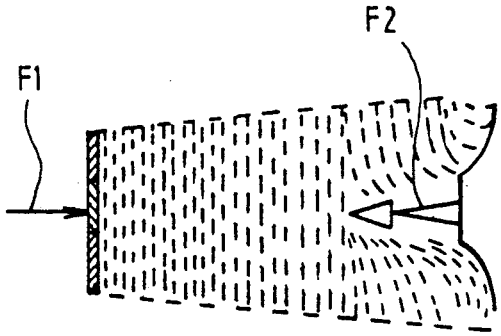
FIG. 4 shows schematically how solid fractions similar to those in FIG. 3 are orientated, but in this case in an apparatus according to the invention.

FIG. 4 is a diagram similar to that in FIG. 3, but corresponds to the application of the process according to the invention. It can be seen that a retaining force F2 is created in the center of the apparatus and at the outlet of the latter and is directed oppositely to the direction of the arrow F1 indicating the direction in which the mixture to be pressed is introduced into the apparatus. This retaining force F2 is due to the presence of a central conical shield situated at the outlet of the apparatus.

Contrary to what is known, the direction of the force F2 is therefore here the opposite of the direction of the arrow F1, because it is a retaining force. It might be thought that this retaining force originates directly from the resistance offered by the central shield, but actually the situation is more complex, because after an initial starting phase the solid fractions accumulate to form a "cake" or "sausage" in front of the shield, and the mixture to be pressed is compressed onto the cake and not directly on the shield. In a press for vegetable materials, there are therefore two states of the material to be pressed: at the inlet the mixture is in the natural state and at the outlet the dry (or semi-dry) material is heavily compressed and hard. Between these two extreme states there are intermediate states. The retaining force F2 and the pressure P1 are certainly antagonistic (i.e. opposed) in the process according to the invention, but the retaining force F2 is caused by the resistance of the cake to discharge. This resistance is obviously due to the presence of the shield, but the latter counteracts the pressure P1 only indirectly, with the interposition of the cake.

This arrangement, which is moreover diagrammatically indicated in FIG. 2, has the consequence that, since the pressure P1 has a maximum value at the center and a minimum value on the periphery, the solid particles remain practically oriented at right angles to the force F2, even on the periphery, so that they are oriented in the direction most favorable to the extraction of liquid fractions.

Figure 5:
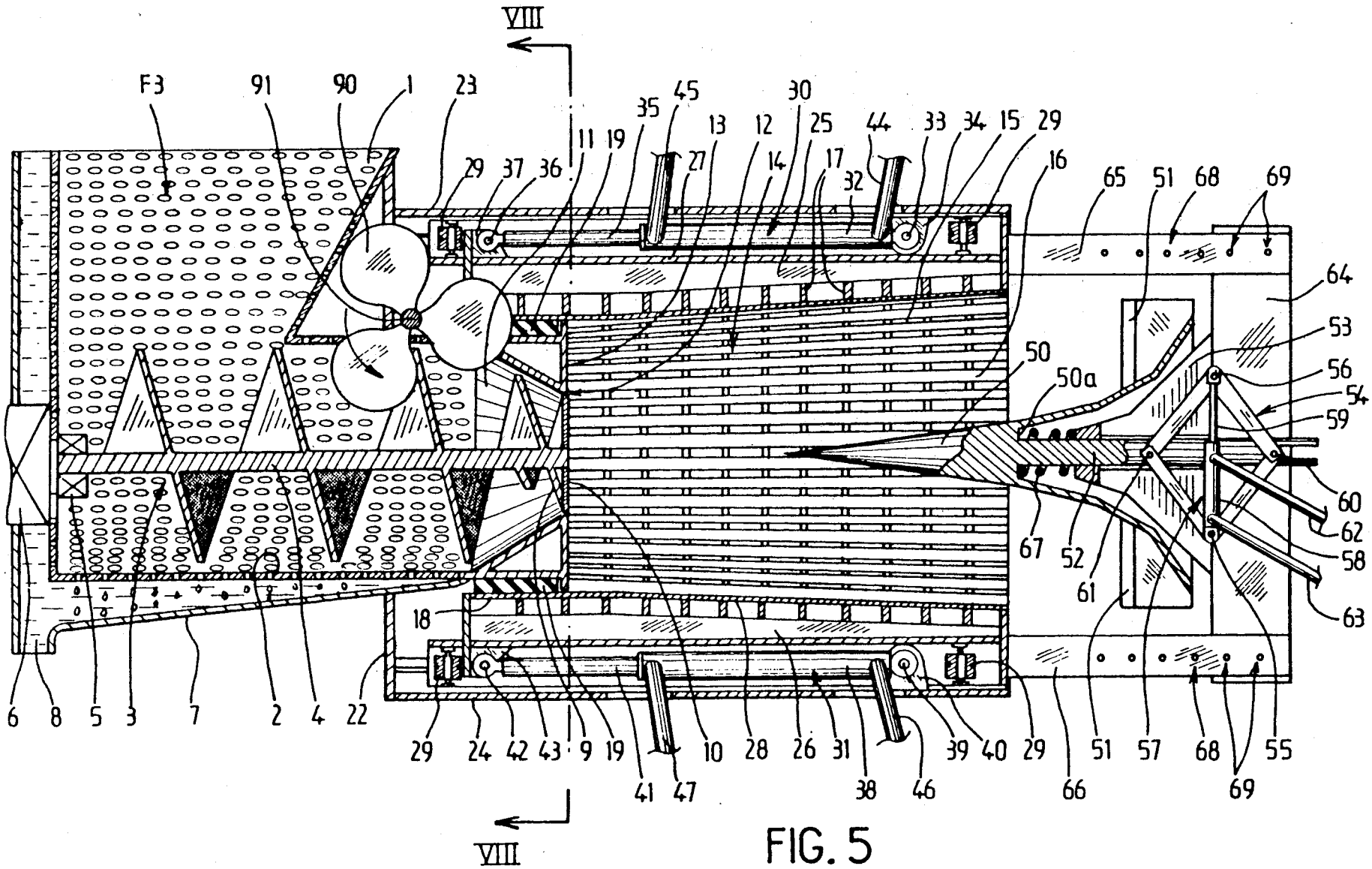
FIG. 5 is a schematic view in longitudinal section of an apparatus applying the process according to the invention, in a first embodiment providing for the pressure to be obtained by moving the pressing vessel relative to a part forming a piston and held stationary.

Referring now to FIG. 5, an example is seen of the structure of an apparatus applying the process according to the invention.

This apparatus includes a hopper 1 for loading with a heterogeneous mixture, and the description below relates, as an example, to wine grapes which are to be pressed in order to obtain a juice which is as clear as possible and which after treatment such as fermentation or distillation will produce an alcoholic beverage, particularly wine or else cognac.

The hopper 1 discharges into a trough-shaped tank 2, which, e.g., has a bottom of circular section and divergent planar walls. A worm screw 3 extends in this tank 2 with its stem 4 held by a bearing 5, and is connected to a motor 6 for rotating it.

The walls of the hopper 1 and of the tank 2 are perforated in order to allow the passage of juice draining off, which is received in a casing 7 surrounding the hopper 1 and the tank 2 and provided with a discharge aperture 8.

At its opposite end to that which is near the motor 6, the worm screw 3 has a second screwthread 9 having the same pitch as the main thread and having its end diametrically opposite the latter, both threads terminating in a plate 10 at right angles to the stem 4, in order to form an obstacle to the return of the mixture into the tank 2 from the downstream to the upstream side, as will be more fully explained below.

It will be noted that the diameter of the worm screw 3 is constant inside the tank 2 and decreases at the position of a sleeve 11 whose interior is frustoconical and which thus has a central circular passage 12 of a diameter smaller than the section of the tank 2 and which also has an annular portion 13 coplanar with the plane 10, this device being intended to serve as a piston.

It would also be possible to provide a solid central portion around which an annular passage would be formed for the transfer of the mixture by the worm screw 3.

Facing the sleeve 11, a vessel 14 is situated, which vessel 14 has a frustoconical shape with its small base near the sleeve 11 and constituting the inlet of the vessel 14, while its large base, opposite the inlet end, constitutes the outlet for the solid fractions. In other words, the diameter of the vessel 14 increases in the "upstream-downstream" direction, i.e., in the direction from the mixture inlet to the outlet for solid fractions.

The walls of the vessel 14 are perforated in order that the liquid fractions separated from the solid fractions introduced and pressed in the vessel 14 can pass through them.

Figure 6:
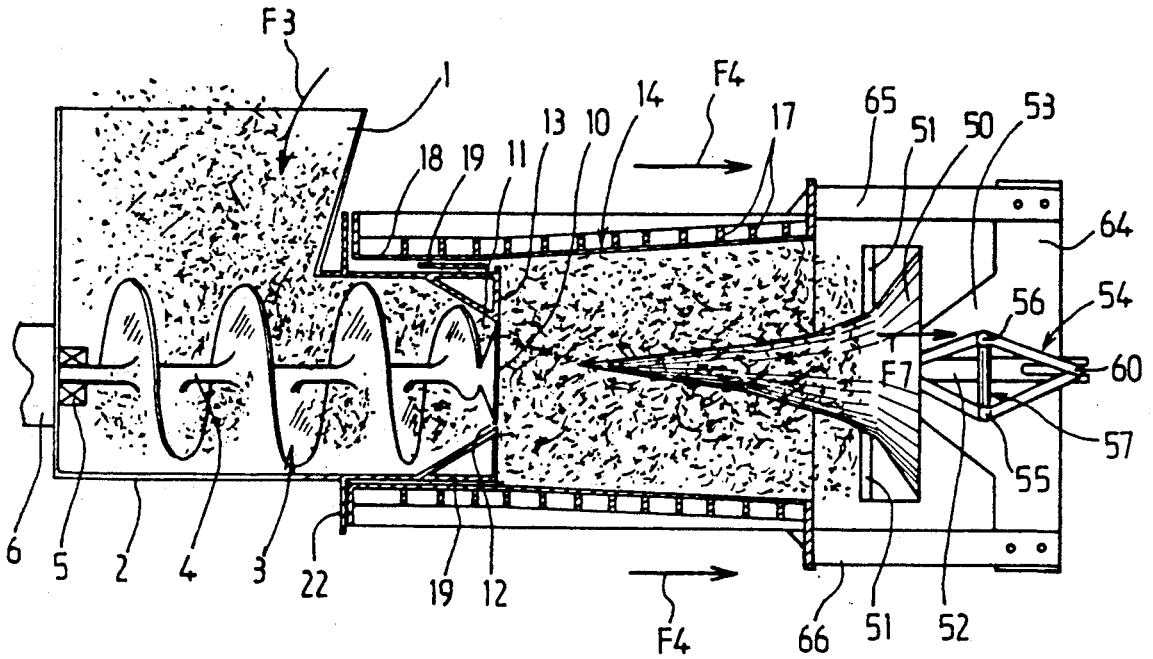
FIGS. 6 and 7 are schematic views in section showing in two phases of operation the apparatus shown in FIG. 5.
Figure 7:
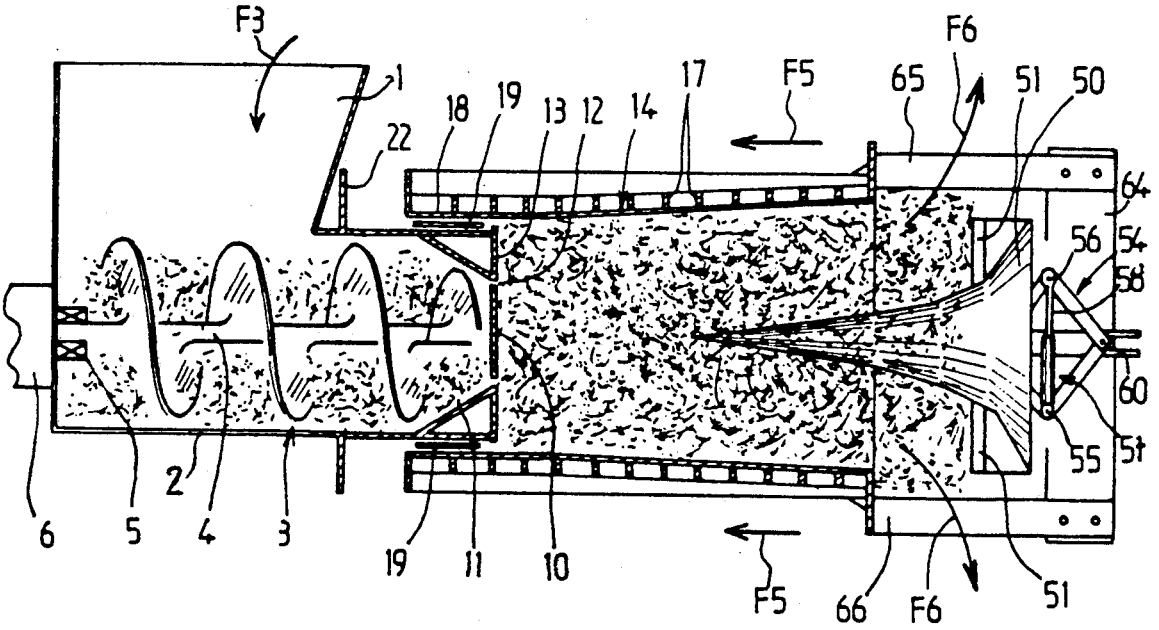
Figure 8:
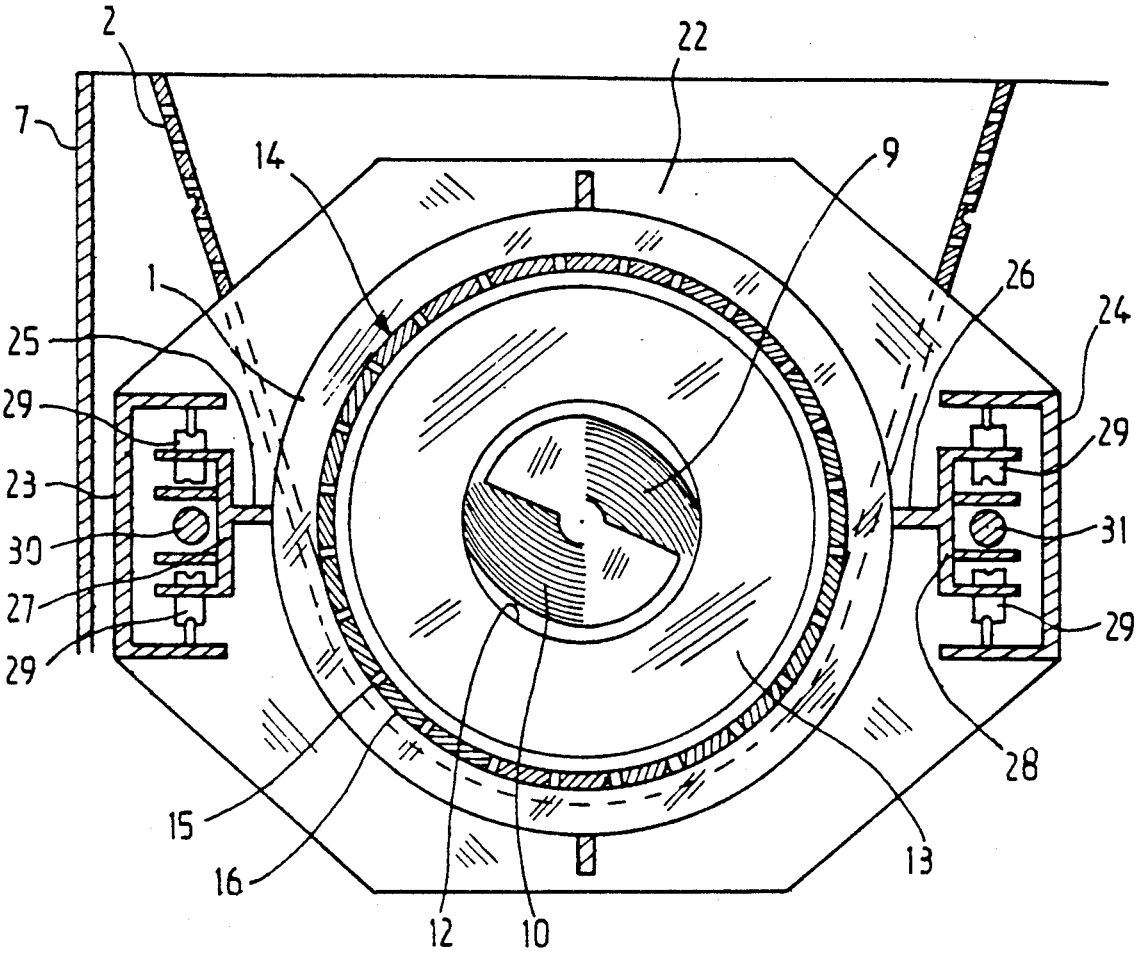
FIG. 8 is a schematic view of the apparatus shown in FIG. 5, in section taken on the line VIII—VIII in FIG. 5.

FIGS. 5 to 7 show the perforations in the vessel 14 in the form of slots 15 formed by gaps between solid parts 16 held together by external circular reinforcements 17 giving the whole arrangement the rigidity of a gap-free structure. In practice, use may be made of a different structure, particularly a grid of sheet metal perforated with oblong apertures whose longer axis is parallel to the axis of the vessel 14, this grid being of a type known per se. It is known that in this case the grid must be held rigidly in the radial direction in order to withstand the thrust of the mixture being pressed, and for this purpose use may be made of reinforcements of the type shown here (i.e. reinforcements 17)

The vessel 14 has a cylindrical extension 18 whose inside diameter corresponds to the outside diameter of the sleeve 11, with the interposition therebetween of seals or of means facilitating the sliding of the extension 18 on the sleeve 11 or avoiding the effects of metal-to-metal friction, these means being given the general reference 19.

An external flange 22, to which are fastened two longitudinal sectional members 23 and 24, is secured on the fixed assembly comprising the hopper 1, tank 2, and casing 7.

On the circular reinforcements 17 of the vessel 14 are fixed longitudinal members 25 and 26 supporting sectional members 27 and 28 extending inside the sectional members 23 and 24.

Rotating rollers 29 ensuring the friction-free guiding of the inner sectional members 27 and 28 in the outer sectional members 23 and 24 are disposed between the members 23 and 27 on the one hand and between the members 24 and 28 on the other hand.

Jacks 30 and 31 are provided inside the sectional members 27 and 28 for the purpose of moving the vessel 14 in relation to the coplanar parts 10 and 11 forming a piston.

To this end, the body 32 of the jack 30 is fixed by an eye 33 and a bracket 34 to the sectional member 23, while the rod 35 of the jack 30 is connected by an eye and a bracket 37 to the sectional member 27.

Symmetrically, the body 38 of the jack 31 is fixed by an eye 39 and a bracket 40 to the sectional member 24, while the rod 41 of this jack 31 is fixed by an eye 42 and a bracket 43 to the sectional member 28.

The jacks 30 and 31 are of the double-acting type and therefore have fluid inlets 44–45 and 46–47 respectively, which are controlled by solenoid valves, as is known per se, for extending and retracting the rods 35 and 41.

The downstream end of the vessel 14 is entirely open and permits the accommodation of a central conical shield 50 associated with radial choppers 51 and fastened to an axial rod 52 mounted for sliding in a guide 53.

The shield 50 is associated with a diamond-shaped linkage 54, of which two opposite apexes 55 and 56 are connected to a jack 57, that is, respectively to the body 58 and the rod 59 of the jack, while the other two opposite apexes 60 and 61 are connected respectively to a fixed point and to the rod 52.

This jack 57 contains a pressurized fluid and serves as a shock absorber, and it is advantageous to be able to adjust the passage section of an inlet 62 and an outlet 63 by any known means, in order to adjust the value of the resistance offered by the jack 57 to the forces exerted on it by the conical shield 50, which itself is subjected to the thrust of the mixture.

The guide 53 is fixed to a cross member 64 connecting two supports 65 and 66 fastened to the vessel 14.

The operation of the apparatus described above is as follows:

The mixture to be separated is introduced into the hopper 1 in the direction of the arrow F3 as shown in FIG. 6, in such a manner that it falls into the tank 2, where it is drained, and between the turns of the worm screw 3, the latter being driven rotationally by the motor 6 in order to move the mixture in the downstream direction and to introduce it into the vessel 14 through the central opening 12.

It will be observed that the rotation of the worm screw 3 does not give rise to any substantial pressure, but simply effects compaction resulting from the frustoconical internal shape of the sleeve 11.

When the mixture reaches the vessel 14, it fills the latter in a natural manner in proportion as new fractions of mixture are introduced into the vessel 14 by the worm screw 3.

On commencement of the filling operation, the jacks 30 and 31 are controlled to bring the vessel 14 into the position shown in FIG. 6, in which the cylindrical portion 18 completely covers the sleeve 11, so that the vessel 14 has a minimum volume.

In this position the pressures in the pressurized fluid pipes 44, 45, 46 and 47 are suppressed, in order that the jacks will be inactive.

The vessel 14 moves from the upstream to the downstream side because of the arrival of the mixture applying thrust to it, this backward movement of the vessel making room for further amounts of incoming mixture. It should be noted here that only a simple thrust occurs, without compression, because the vessel 14 moves without effort and because no force is generated to oppose the admission of mixture. When the vessel 14 arrives at the end of its stroke, pressurized fluid is admitted into the jacks 30 and 31 through the inlets 44 and 46, in order to move the vessel 14 in the direction of the arrows F5 as shown in FIG. 7, towards its minimum volume position, which has the effect of driving the shield 50 in the same direction by means of the supports 65 and 66 and the cross member 64, the cylindrical part 18 sliding on the outer cylindrical part of the sleeve 11.

The jack 57 in turn acts in a direction such as to bring the apexes 55 and 56 of the diamond-shaped linkage closer together, that is, to move the apexes 60 and 61 apart, the rod 52 thus tending to push the shield 50 towards the interior of the vessel 14, in the downstream-upstream direction. The shield 50 thus checks the free discharge of the mixture.

The displacement of the vessel 14 relative to the fixed sleeve 11 therefore brings about the compression of the mixture between, on the one hand, the annular wall portion 13 and the terminal plane 10 of the screw 3, which are coplanar, and on the other hand the central shield 50, with the interposition therebetween of the dense cake already formed. The wall 13 and the plane 10 constitute, in a manner of speaking, a piston against which the mixture is pressed through the action of the jacks 30 and 31, this pressing giving rise to the discharge of the liquid fractions through the slots 15 in the vessel 14, while the solid fractions accumulate in the form of a dense cake towards the downstream side of the vessel 14. When the cake acquires a degree of dryness determined by the adjustment of the pressure in the jack 57, it is forced against the choppers 51, which divide it into fragments which leave the apparatus in the direction of the arrows F6, by way of the annular passage.

The shield 50 itself is subjected to two opposing forces: the thrust of the cake in the direction of the arrows F4 as shown in FIG. 6, and the resistance to this force exerted by the jack 57 on the shield 50. When the solid fractions of the mixture, after extraction of the liquid fractions, have been agglomerated to form a cake, this cake acts strongly on the shield 50, which can move back against the action of the jack 57 until an equilibrium, determined by the adjustment of the pressure in the jack 57, is achieved. When the thrust of the cake increases, the shield 50 moves back slightly and, because of its shape, correlatively enlarges the passage section offered for the discharge of the solid fractions, this section being determined by the width of the annular passage existing between the exterior of the cone 50 and the interior of the vessel 14.

This results in regulation of the resultant pressure exerted on the mixture, on the basis of the adjustment made to the jack 57, as a result of which the pressing action can be modulated to obtain the desired percentage of liquid fraction in relation to the solid fractions. In other words, the position of the shield 50 determines the passage section, the intensity of the retaining force and the residual moisture content of the cake, that is, the value of the "pressing".

In order to damp the forces transmitted to the jack 57 by the shield 50, particularly vibrations and shocks, it is possible to interpose a suitably calibrated spring 67 on the rod 52 between the rear face 50*a* of the shield 50 and the fixed guide 53 as shown in FIG. 5.

It will be observed that the compression of the mixture inside the vessel 14 is achieved by a simple linear movement in which the screw 3 does not intervene at all by its rotary action, because on the one hand it is stopped during the pressing phase, and on the other hand because the mixture in the vessel 14 is practically prevented from reaching the screw 3 by the action of the plane 10. It should be observed that with this form of construction the pressure is applied from downstream to upstream in the direction of the arrows F5, and not from upstream to downstream.

The worm screw 3 thus serves here solely as a material conveying mechanism, and consequently could be replaced by any other device found to be more suitable than a worm.

Because of the frustoconical shape of the vessel 14, the mixture is moved from upstream to downstream, from the small base to the large, thus eliminating the phenomenon of grating and rubbing and also permitting a better flow of the mixture and also the complete absence of trituration, since the solid particles are orientated as shown in FIG. 4, as has been explained above. The section of the vessel 14 could obviously differ from the circular shape, being for example oval.

The increase of pressure represented by curve B in FIG. 1 is achieved by means of the conical shield 50 and the jack 57 associated with it. The shape and dimensions of the shield 50 can be adapted to different conditions of use. In all cases, since the shield is situated on the axis of the apparatus, it is clear that the pressure P1 is highest at the center and that it declines towards the periphery, because the outlet is annular in shape.

The different possible forms of intervention, both in respect of original dimensions and in respect of adjustments in the course of operation, permit homogeneous and increasing distribution of the compression forces, this distribution preventing the bursting of solid particles and the imprisonment of juice in solid matter, as a result of which lower pressures can be applied than are necessary in the known apparatus.

If the shield cone 50 is made fairly slender, starting from its apex, and if the widening of the cone 50 is sharply increased, as shown in FIG. 5, a passage section is obtained which decreases progressively and then more abruptly, correlatively producing a retaining force increasing slightly and then more sharply in order to achieve effective extraction of the liquid fractions at the end of the cycle.

The drying of the mixture is thus modulated in accordance with the pressure prevailing in the jack 57 and therefore in accordance with the retaining force of the shield 50.

The different functions can obviously be carried out by means of a central automatic control station receiving information from limit stops, contactors, sensors, pressure gauges, and the like.

Figure 9:
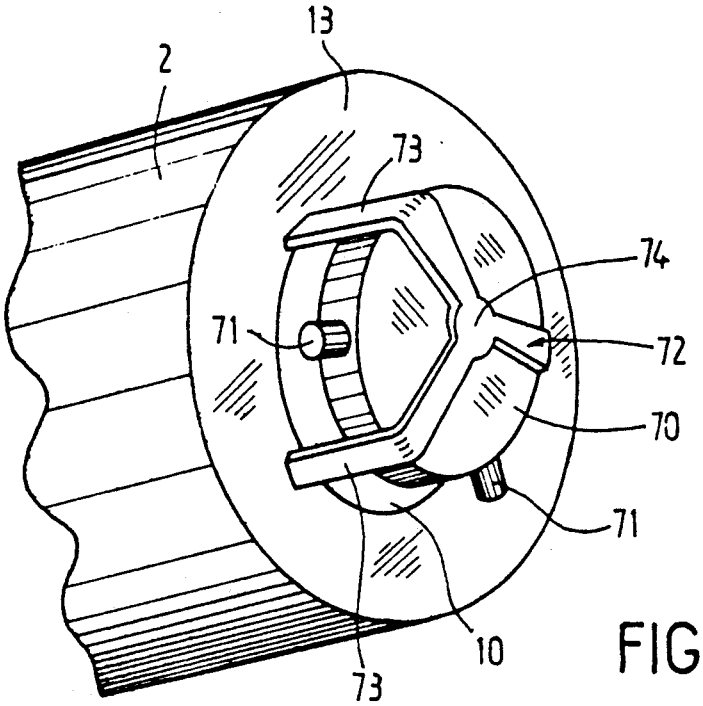
FIG. 9 is a partial schematic view showing a variant of the invention in which a non-return valve is provided between the pressing vessel and the inlet tank.

In order to prevent any return of mixture from the vessel 14 to the tank 2 when the vessel 14 is moved in the direction of the arrows F5, a non-return valve may be provided, as illustrated in FIG. 9. In this figure, the sleeve 11, its front part 13 and its central passage 12, through which the mixture is introduced into the vessel 14, are shown schematically. The non-return valve is composed of an obturator 70 having a diameter equivalent to that of the passage 12 and provided with peripheral projections 71 by which it bears against the front part 13 when subjected to pressure in the direction of the arrows F5, in which position the passage 12 is completely closed.

The obturator 70 is capped by a retaining member 72 comprising arms 73 fixed to the part 13 and curved towards a common center 74, against which the obturator 70 comes to bear when it is subjected to pressure in the direction of the arrows F4, that is, when the worm screw 3 is rotated and pushes the mixture through the central passage 12.

Figure 10:
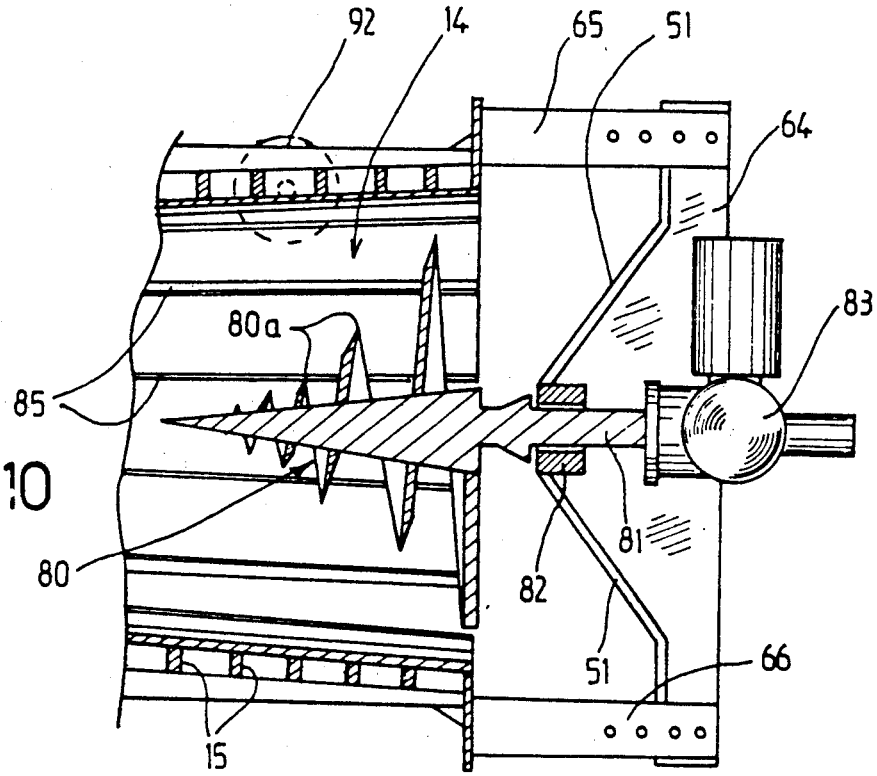
FIG. 10 is a partial schematic view showing a second embodiment of the invention in which the retaining force is produced by a screw shield, which in addition serves as an evacuator for the solid fractions.

FIG. 10 illustrates a variant of the means used for discharging the solid fractions. It will be observed that the conical shield 50 is dispensed with and replaced by a central worm 80 whose diameter increases in the upstream-downstream direction and which is fastened to a shaft 81 mounted for rotation in a retaining bearing 82 and connected to a driving mechanism of any known type, such as a motor-reduction gear unit 83.

When the screw 80 is held stationary, it leaves only a narrow helicoidal passage offering great resistance to the discharge of the solid fractions agglomerated into a cake. In order to ensure the appropriate discharge of these solid fractions, it is therefore necessary to drive the screw 80 rotationally, but in the opposite direction to that which would effect compression, and the screw therefore constitutes a solid fraction evacuator when the mixture is placed under pressure by a translatory movement, as has been described previously.

The evacuation of the solid fractions can be modulated by controlling the speed of the screw 80 to achieve very accurate adjustment and excellent adequation of the available apparatus and mixture in all circumstances.

The percentage of solid fractions in relation to the liquid fractions discharged therefore depends on the speed of rotation of the screw 80.

The choppers 51 are again provided, and have the effect of cutting up the solid fractions in order to assist their discharge.

When the screw 80 is rotated, it could have the effect of entraining the solid fractions still contained in the vessel 14, and in order to prevent this rotation obstructing the free discharge of the solid fractions, it is possible to provide inside the vessel 14 longitudinal ribs 85 to which the different components of the mixture become attached, thus preventing their entrainment by the screw 80.

It is useful for the screw 80 to have a pitch which is variable, in the sense of a reduction from its upstream end towards its downstream base, because the volume of the mixture decreases along the screw 80 and requires less space to be provided for it. The pitch of the screw 80 is therefore greater where the turns have a smaller diameter, and its pitch is smaller where the turns have a larger diameter.

In order to permit easy evacuation of the solid fractions, and in particular to avoid clogging due to adhesion to the hub and threads of the screw 80, the threads may be given a sharp profile so as to form external cutting edges 80*a*.

It will be observed that the bearing 82 is fastened to a cross member 64 and to supports 65 and 66, as in the case of the mounting of shield 50 in FIGS. 5 to 7, so that the vessel 14 and the screw 80 are fixed together in respect of translation. The relative positions of the vessel 14 and shield 50 or screw 80 can be adjusted in accordance with the nature of the material to be treated. For this purpose, respective series of holes 68 are provided on the supports 65 and 66, and holes 69 are provided on the cross member 64 to permit selection of the holes which will face one another for the insertion thereinto of connecting bolts. This preadjustment is made in accordance with the characteristics of the mixture to be treated. In the case of grapes for example, a different preadjustment may be desired for the first harvest from that desired for harvests at the end of the season.

The screw 80 is rotated only when the mixture introduced into the vessel 14 is placed under pressure (with the screw 3 stationary) through the extension of the jacks 30 and 31. It is stopped when the jacks 30 and 31 are made inactive and mixture is introduced in the vessel 14, the screw 3 being then in operation.

As is known per se, it is useful to provide a trefoil 90 known as an obturator, which is mounted for free movement on a shaft 91 and which counteracts the winding of the mixture around the stem 4, as shown in FIG. 5.

Near the outlet for the solid fractions, it is also possible to provide circular choppers 92 as shown in FIG. 10 which cut up the cake or "sausage" of dry material and thus facilitate its evacuation through the annular outlet, in the direction of the arrows F6 in FIG. 7.

It is also possible to use trefoil obturators (not shown) associated with the screw 80 in order to prevent material from winding around its stem, and also serving as choppers.

Figure 11:
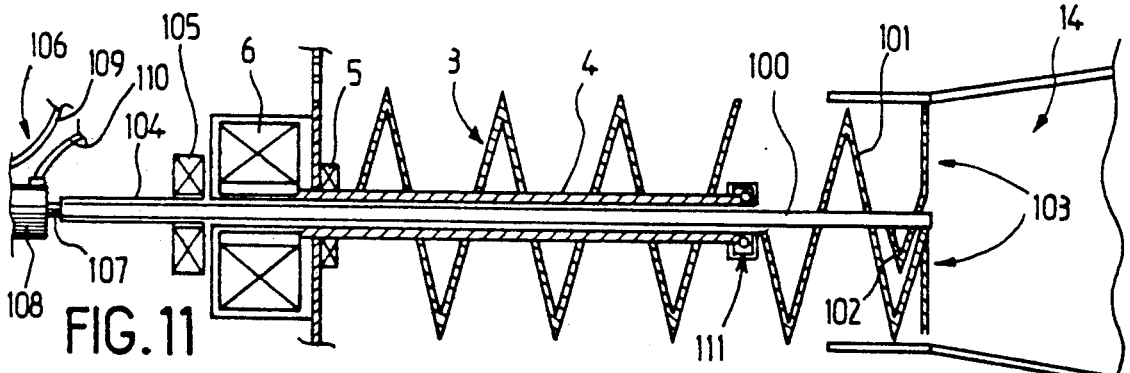
FIGS. 11 and 12 are two partial schematic views showing, in two phases of operation, another embodiment of the invention in which the inlet pressure is obtained by displacing a member constituting a piston relative to the pressing vessel, which is held stationary.

Referring now to FIG. 11, an embodiment can be seen in which the relative linear movement between the vessel 14 and the "piston" is no longer due to displacement of the vessel 14 in relation to the fixed assembly 10-12-13, but on the contrary is due to the movement of a piston assembly in relation to the fixed vessel 14.

It can be seen that the stem 4 of the screw 3 is hollow and receives freely, that is to say without friction and a fortiori without obstruction, a shaft 100 carrying a screwthread 101 corresponding to the thread of the screw 3 and situated in line with the latter. A simplified arrangement has been shown in which there is no frustoconical sleeve 11, and consequently it is assumed that both the thread of the screw 3 and the thread 101 have a constant diameter and are both identical. In reality, the thread 101 may correspond to the end of the screw 3 as shown in FIG. 5.

The screw 3 has only one thread, while the shaft 100 carries a second thread 102 of the same pitch, and the two threads 101 and 102 are shaped at their ends in the manner already described for the screw 3 in connection with FIG. 5, that is, they end in a common plane 103 and are substantially at right angles to the axis of the arrangement.

The shaft 100 has a peripheral spline 104 which extends over a certain length and engages with a motor 105 of any type known per se for driving the shaft 100 rotationally when it is put into operation.

Facing the free end of the shaft 100 is disposed a double-acting jack 106 whose rod 107 is fastened to the shaft 100, while its body 108 is connected to two pressurized fluid pipes 109 and 110.

This apparatus operates in the following manner:

In order to introduce mixture into the vessel 14, the motors 6 and 105 are put into operation simultaneously so that the stem 4 and the shaft 100 are both driven rotationally (the motor 105 driving the shaft 100 by means of the spline 104), and so that the threads 3, 101 and 102 behave as if they were fastened together. In this situation, the jack 106 is fed with pressurized fluid, so that its rod 107 and the shaft 100 will be in their retracted position shown in FIG. 11.

This phase of operation corresponds exactly to what has been described above, and details of its consequences on the mixture being pressed will therefore not be repeated.

When the compression of the mixture is to be effected, only the motor 105 is stopped so as to end the rotation of the shaft 100, while on the contrary the stem 4 continues to turn and the mixture introduced into the hopper 1 continues to be pushed from upstream to downstream. At the same time, the feeding of the jack 106 is reversed, so that its rod 107 will be extended and apply thrust to the shaft 100. The threads 101 and 102 will then act by their coplanar parts 103 as a piston in the stationary vessel 14 and effect the pressing of the mixture in the manner described above, the apparatus being in the position shown in FIG. 12. When the desired pressure has been reached (and detected for example by pressure gauges), the jack 106 is made inoperative and the motor 105 is started up again while still in engagement with the spline 104 because of the length of the latter, but at a speed such that the shaft 100 turns faster than the stem 4, and in the same direction, in such a manner that the threads 101 and 102 "screw", in a manner of speaking, into the mixture lying behind them because of the continuous operation of the thread 3, and move back axially until the shaft 100 has resumed the position shown in FIG. 11. The jack 106 is fed again to apply thrust to the threads 101 and 102, and the cycle starts again. It will be noted that the shaft 100 is driven by the motor 105 whatever the axial position of the shaft 100, and even during its sliding inside the stem 4.

In the upstream-downstream direction, the shaft 100 is pushed by the jack 106, but in the downstream-upstream direction it is returned by the fast rotation imparted to it by the motor 105. A single-acting jack 106 is therefore sufficient.

In order to prevent material from penetrating into the hollow shaft 4, a packing seal 111 is provided on the end of hollow shaft 4, which seal can also serve as a support and guide means for shaft 100 if shaft 100 has appreciable play, i.e. is not exactly fit, in hollow shaft 4.

It is important to note that shaft 100 and the vanes of screw conveyor threads 101 and 102 which are borne on shaft 100 act completely independently of screw conveyor 3, in rotation, in speed, and in translational sliding. For this reason, the device is free of the drawbacks recited above in the Background of the Invention section, and indeed provides marked advantages.

Figure 12:
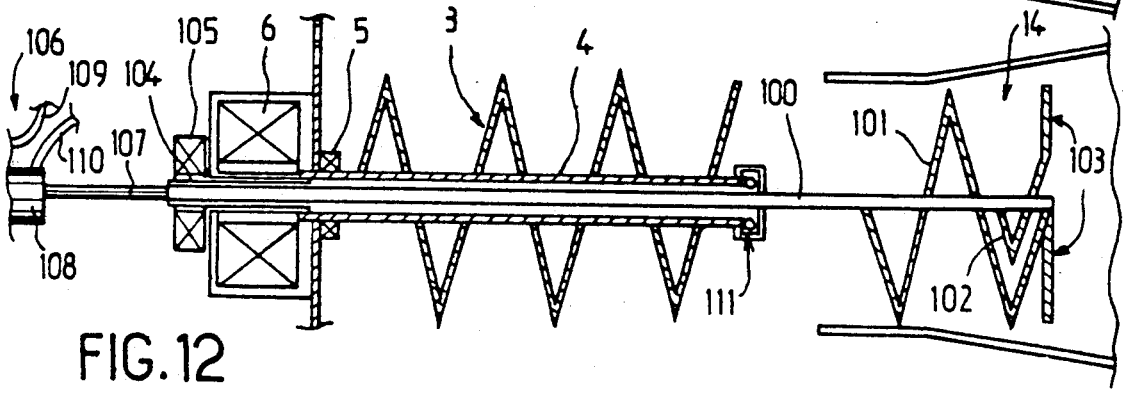

In the embodiment illustrated in FIGS. 11 and 12, the vessel 14 is fixed and the relative movement between vessel and piston is effected by moving the piston, which is a different situation from that of the embodiment illustrated in FIGS. 5–7.

In practice, one might elect a mobile piston in smaller installations, and a mobile vessel in larger installations.

With an embodiment with the vessel 14 fixed and the "piston" mobile, the piston can no longer be comprised merely of a central part such as terminal plane 10 and a surrounding annular constriction structure 11 as in FIG. 5 whereby the compression effect is produced over the entire diameter of the small base of the vessel 14. This mobile piston variant is particularly suited to a case where a check valve 70 is provided, such as described above in connection with FIG. 9.

Figure 13:
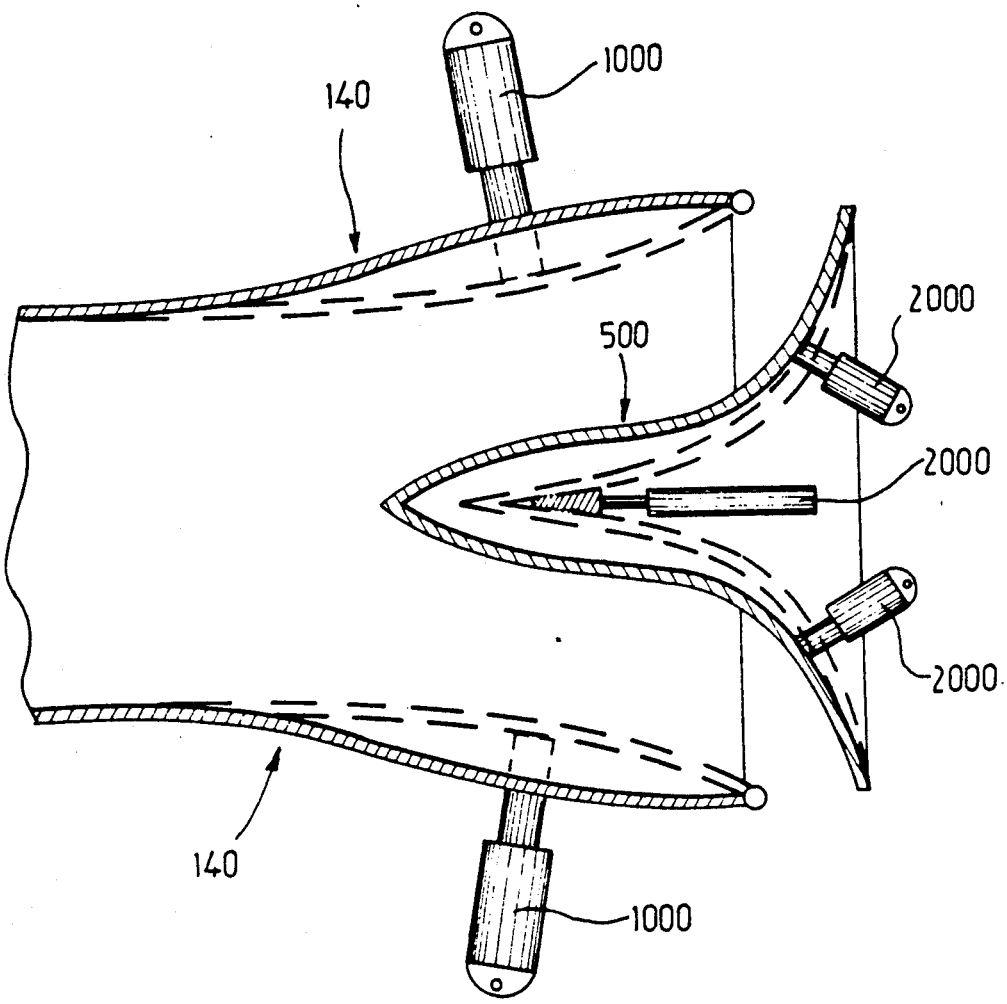
FIGS. 13 and 14 are partial schematic views of two variants of an embodiment of the invention according to which the zone corresponding to the outlet of the vessel and also the retaining shield are adapted to be deformed.
Figure 14:
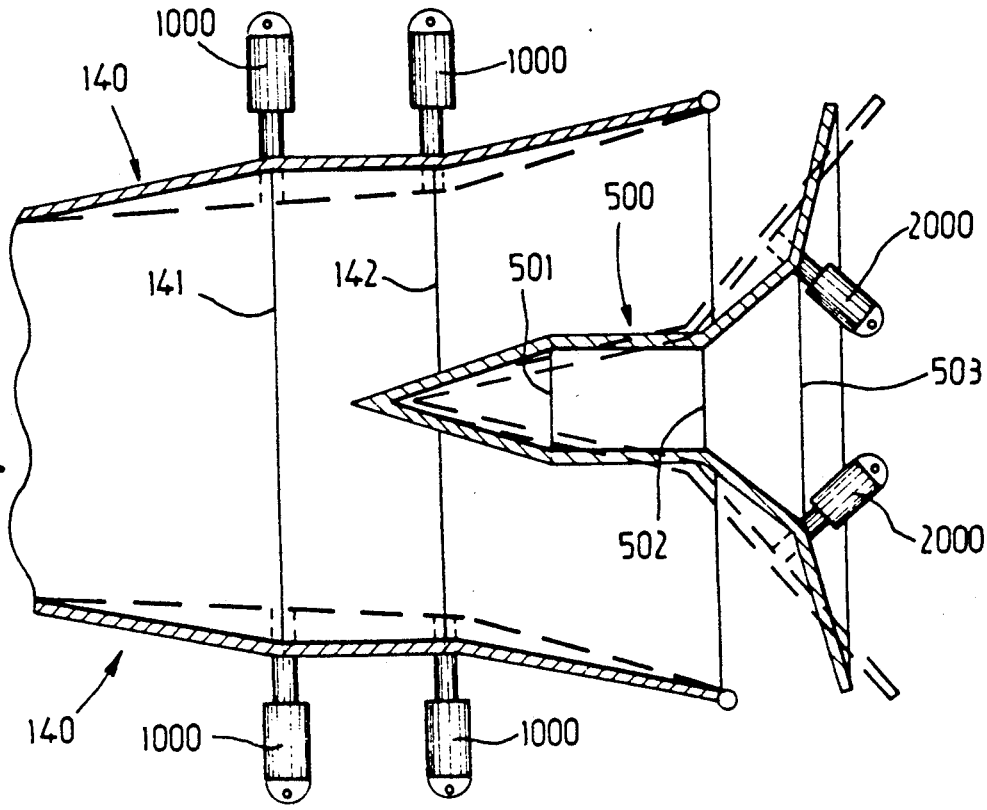

In FIGS. 13 and 14, there are depicted two variants of an embodiment which enables the taking into account of different densities and difficulties which may be encountered in certain circumstances, e.g., grape musts (especially, unfermented musts) having high sugar content, e.g. as from grapes harvested at very high temperature, wherewith a stability over time of the amounts or other parameters of the solid fractions at the outlet of the vessel is not possible, which stability is a favorable condition for good operation of the device.

In other circumstances, certain materials to be pressed require relaxation of the interior pressure of the material in the vessel prior to a final pressing at elevated pressure.

According to the invention, the pressure is progressively increased in a uniform fashion over the entire volume of material present, with maximum pressure at the end of the vessel; however, as will be described below, the appreciable zone where the contact is produced between the material to be pressed and the end of the vessel is not controlled, nor is the annular outlet space of the end region of the vessel. It would seem useful to intervene and control these circumferential zones in order to prevent the escape of unpressed materials which may be present at the periphery of the solid materials at the center (which central materials have already been pressed).

With the embodiment of FIGS. 13 and 14, the shapes of the vessel and the shield element are both rendered modifiable and adjustable in the region of the outlet end of the vessel. With regard to the shield, it is particularly the conicity which is variable.

In FIGS. 13–18, parts corresponding to those described earlier with reference to earlier Figures are assigned corresponding reference numerals, but multiplied by ten (e.g., the vessel 14 becomes 140, the shield 50 becomes 500, etc).

In FIG. 13 the vessel 140 and shield 500 are surfaces of revolution with curved generatrices. The depicted solid line positions represent one coordinated position of these two elements. If one applies a force to the end region of the wall of vessel 140 which force is directed toward the axis of the vessel, e.g., by means of regularly distributed hydraulic (or pneumatic) cylinders 1000, one can impart a contracted shape to the end (i.e. exit) region of the vessel 140, depicted by the dashed lines. The material of construction provided for the walls of the vessel 140 in this exit region is deformable.

By means of the hydraulic (or pneumatic) cylinders 1000, the shapes are adjusted to variably control the cross-sectional area through which the pressed residue (i.e. retentate) material exits.

The situation is similar for the shield 500 and its associated hydraulic (or pneumatic) cylinders 2000. Only representative principal ones of such cylinders are illustrated; the actual number and disposition of the cylinders is discretionary.

By means of the hydraulic or pneumatic cylinders 1000 and 2000 not only is one able to vary the total cross-section of the passage, but the variation can be adjusted by zones. For example, the shield 500 may be given a very small cross section downstream of a very large one, in order to produce a major pressure decrease in the pressed residue material as the material is displaced in the downstream direction.

FIG. 14 illustrates a variant according to which the forms of the vessel 140 and shield 500 are not curved but are generated by straight line segments, with inflections indicated by "inflection lines" 141, 142, 501, 502, and 503.

By means of the hydraulic or pneumatic cylinders 1000 and 2000, one can impart a cross-section to the outlet region of the vessel 140 which cross-section varies with length (i.e. contracts or expands) or is constant.

Of course, the actuators 1000 and 2000 are only one choice of means among many candidates, the essential characteristic being the capability of bringing about a constriction of the outlet cross-section, either by (essentially diametrically) contracting the vessel 140 or by extending the shield, or by causing both simultaneously.

Figure 15:
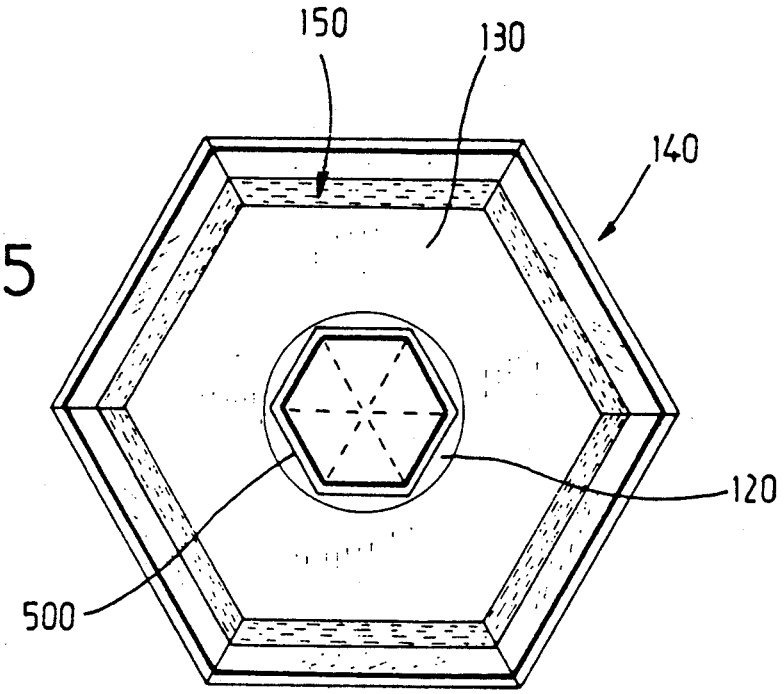
FIGS. 15 is a schematic transverse view from the downstream to the upstream side of the vessel, showing the vessel and the shield as having a polygonal section.

A simplification may be introduced if the cross-section of the vessel 140 and/or that of the shield 500 is not circular but polygonal, as illustrated in FIG. 15.

FIG. 15 shows a vessel 140 in the form of a truncated hexagonal pyramid in which the small base, disposed upstream, is delimited by a wall 130 which has a central inlet orifice 120 for introduction of the material to be pressed. The large base of the truncated pyramid is open, whereby the solid materials exit in the downstream direction. The shield 500 here is in the form of a hexagonal pyramid.

Any polygonal cross-sections may be employed, including squares or rectangles, provided that the inlet cross-sectional area (i.e. the orifice 120 in wall 130) is less than the outlet cross-sectional area.

Figure 16:
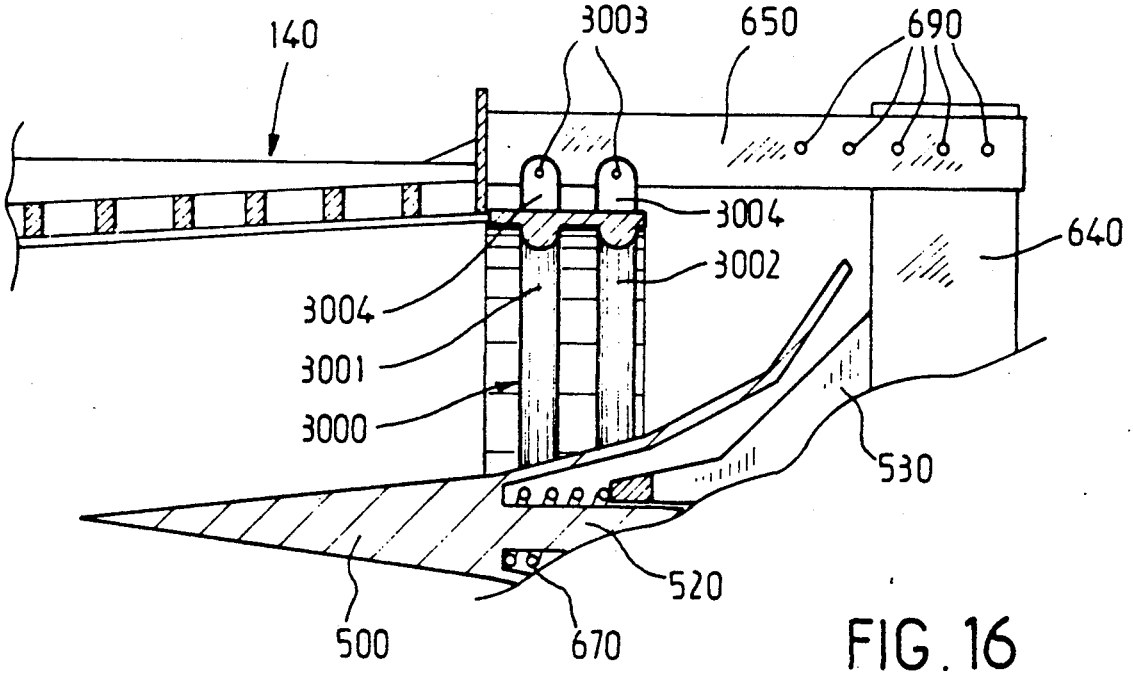
FIG. 16 is a partial schematic longitudinal view showing a fixed brake mechanism situated at the outlet of the vessel.

FIG. 16 shows a skirt 3000 in the annular passage bounded by the base of the vessel 140 and by the shield 500, which skirt 3000 has a substantially circular cross-section. It has the effect of extending the length of the vessel 140 generally transversely to the shield 500, which reduces the outlet cross-section. The restraining effect is amplified by the ridges 3001 and 3002 provided interiorly on skirt 3000. While the skirt 3000 is useful in certain cases, it is not useful, or is even deleterious, in others. Accordingly, advantageously it is removable. For this purpose, it is affixed to supports 650 and 660 by bolts 3003 which engage in holes in lugs or brackets 3004 and in holes in the supports 650, 660.

Figure 17:
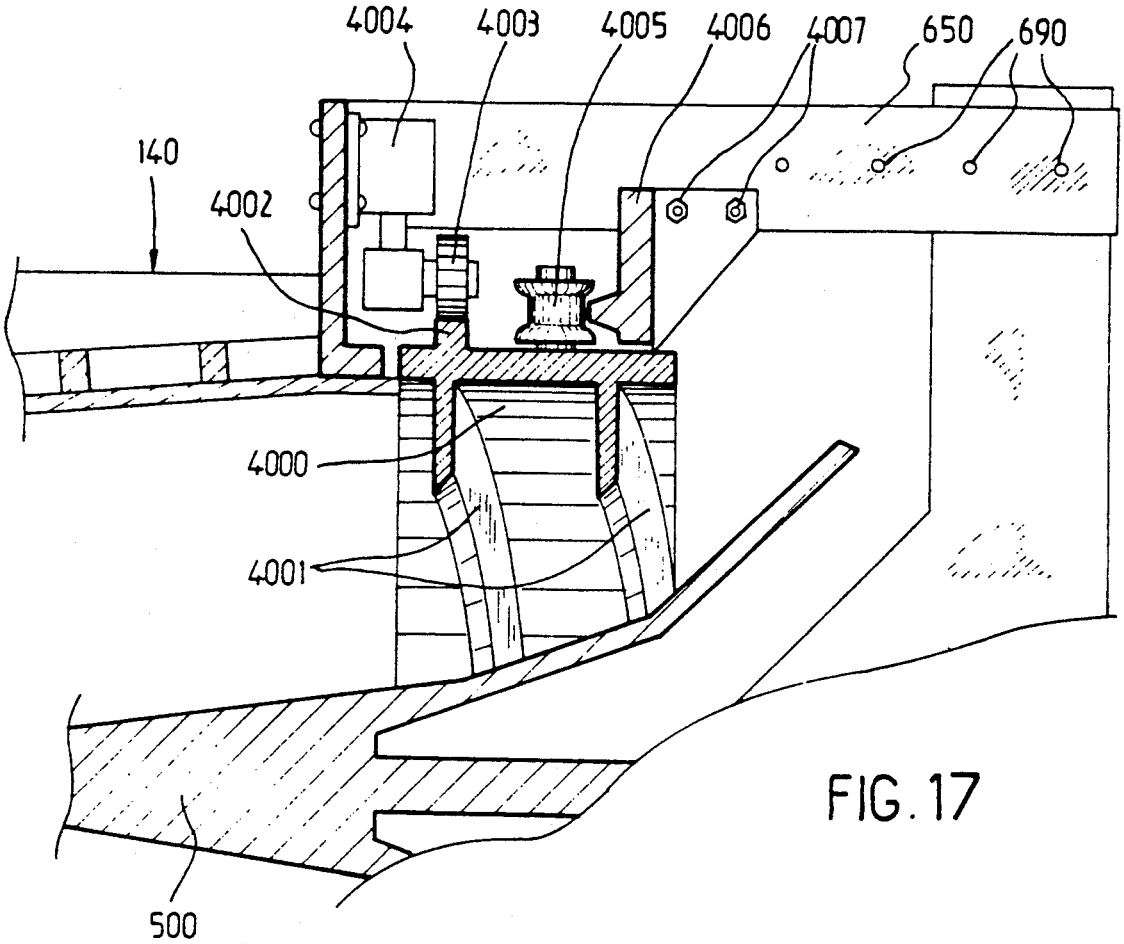
FIGS. 17 and 18 are partial schematic longitudinal views of two variants of a rotary brake mechanism disposed at the outlet of the vessel.

FIG. 17 illustrates another embodiment of a restraining mechanism at the vessel outlet, wherewith instead of a fixed skirt 3000 a rotary extension member 4000 is provided which bears internal vanes 4001 and is rigidly bound to an external crown gear 4002 which is engaged by a pinion 4003 of a geared motor 4004. The rotary extension member 4000 bears external rollers 4005 each of which is mounted on its own respective pivot and each of which engages an annular guide 4006 fixed to supports 650, 660 by bolts 4007.

The restraining effect is achieved by rotating the rotary extension member 4000 at an appropriate rotational velocity. The vanes 4001 are oriented such that the rotation of the extension member 4000 results in removal and not compression of the solid fractions. Thus, there is always restraint, but the restraint increases as the rotational speed of the extension member 4000 decreases.

The rollers 4005 and guide 4006 may be replaced by any equivalent means, e.g., bearing surfaces comprised of anti-friction material.

Figure 18:
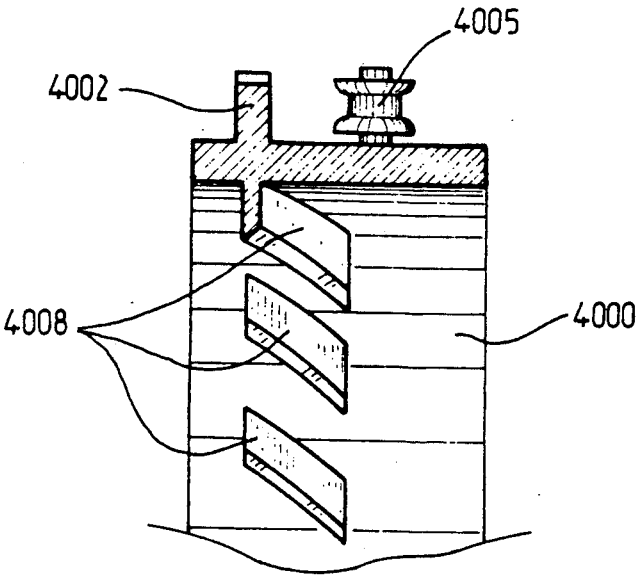

FIG. 18 illustrates a variant according to which the rotary extension member 4000 is interiorly equipped with a plurality of blade-like (i.e., discontinuous) vanes 4008.

When the mixture to be pressed is admitted into the vessel 140, the restraining mechanism is at rest. When a relative translational movement is imparted to the assembly comprising the vessel 140 and shield 500, in order to press the mixture against the wall 130, the rotary extension member 4000 is rotated at a specified rotational velocity, which is preferably controllable, and which enables the solid pressed residue fractions to exit from the vessel 140. In regulating the rotational velocity of the member 4000, one adapts the restraining effect to the characteristics of the mixture being treated, and one regulates the discharge of the pressed residue fractions.

It will be appreciated from the above description that the inventive method, accomplished by a corresponding apparatus, produces a maximal restraining force at the mixture outlet, and does not produce any substantial compressive pressure at the entrance; this is in contrast to the situation when known methods and devices are used.

The optimal conveyance and orientation of the solid fractions which results considerably reduces the resistance to extraction of the liquid fractions.

The invention is particularly applicable to pressing of grapes, but may also be employed for other industrial or natural products, e.g., olives, certain grains, etc.

The invention may also be employed for small-scale press/mixers for juicing fruits, melons, and vegetables. These may be designed even for producing volumes less than the juice of a single orange or less than the volume of a single drinking glass. In this case, the shield may itself be of a filtering type, i.e., may be perforated with passages to enable the escape (and separation out) of liquid fractions which may still be present at the downstream end of the vessel.

Such small devices are particularly amenable to simplifications, especially with regard to the manner in which the restraining force is produced. The restraining force may be produced without regulation means, or with means which are simpler than, e.g., the linkage 54 and the hydraulic (or air) cylinder 57. These simplifications do not only involve changes in dimensions but also changes in function, because if the pressing is carried out continuously, one must provide (as described) a continuous restraining force which is coordinated with the continuous removal of the solid fractions. However, if the device operates batch-wise for one or a number of fruits, the restraining force may be constant and independent of the removal, which removal will be carried out, e.g., in a single step after the pressing.

I claim:

1. An apparatus for pressing a heterogenous mixture for separating therefrom solid and liquid fractions intimately associated therein, comprising;

a longitudinal vessel having side walls pierced with a plurality of fine openings for passing liquid therethrough, said vessel having opposite open ends, one end of said vessel being an upstream inlet end and provided with an opening for admission into said vessel of a heterogenous mixture of intimately associated solid and liquid fractions, the other end of said vessel being an open downstream outlet end for the evacuation of solid fractions from said vessel;

a piston means situated at the upstream inlet end opening of the vessel and coaxially with respect to a longitudinal axis of said vessel, for imparting axial pressing forces upon said heterogenous mixture in said vessel; and central conical shield means accommodated coaxially in the downstream outlet end opening of the vessel, for receiving and reacting thrust forces acting upon said heterogenous mixture in said vessel and, in conjunction with said vessel, for providing an annular discharge passage around said shield means at said downstream outlet end opening for evacuation of said solid fractions therethrough;

said piston means, said shield and said vessel being mounted for relative movement between said piston means and said shield and vessel for pressing the liquid and solid fractions in said heterogenous mixture between the shield and the piston means for forcing the liquid fractions of said mixture to pass through the vessel side walls via the fine openings therethrough and for forcing the solid fractions of said mixture to be discharged around said shield means through said annular discharge passage.

2. An apparatus according to claim 1, further comprising:

means for elastically mounting said shield means for movement in the longitudinal direction of said vessel whereby said shield may be moved coaxially relative to said downstream outlet end opening of said vessel for enlarging or decreasing said annular discharge passage; and means for effecting relative linear movement between said vessel and said piston means.

3. An apparatus according to claim 2, further comprising;

a tank provided proximate the upstream end opening of said vessel, said tank having a hopper for the introduction thereinto of said heterogenous mixture, said tank including a hollow sleeve situated at one end of the tank adjacent said vessel upstream end opening and coaxial therewith, said hollow sleeve having a front wall facing said vessel upstream end opening which front wall is provided with a central opening passing therethrough; and rotatable axial worm screw means provided in said tank and situated facing said hollow sleeve front wall central opening, and including an axial screw for conveying said heterogenous mixture introduced into said tank through said tank and said hollow sleeve front wall central opening and into said vessel with rotation of said worm screw means, a free end portion of said axial screw being adjacent said front wall central opening and being provided with at least one vane substantially perpendicular to the axis of said screw.

4. An apparatus according to claim 3, wherein said piston means is comprised of said front wall of said hollow sleeve of said tank and said at least one substantially perpendicular vane of said free end portion of said axial screw of said worm screw means.

5. An apparatus according to claim 3, wherein said piston means is axially stationary and said vessel is mounted for movement along the longitudinal axis of the vessel.

6. An apparatus according to claim 3, wherein said axial screw of said worm screw means is provided at the free end portion thereof with at least one screw thread independently rotatable relative said axial screw and substantially perpendicular with respect to the axis of said axial screw, and which at least one screw thread is kinematically connected with respective means for driving only said at least one screw thread for rotational and axial translation, respectively, independently of said axial screw.

7. An apparatus according to claim 6, wherein said axial screw of said worm screw means has a hollow stem, and wherein said axial screw further comprises a screw shaft passing coaxially and freely through said hollow stem, said at least one screw thread of said axial screw being provided on a free end of said screw shaft extending from free end of said hollow stem, said screw shaft being kinematically connected with respective means for driving said screw shaft for rotation and axial translation independently of the hollow stem of said axial screw.

8. An apparatus according to claim 3, wherein said hollow sleeve front wall central opening is provided with a non-return valve for preventing return of said heterogenous mixture from said vessel to said tank.

9. An apparatus according to claim 1, wherein said vessel side walls have a selectively deformable profile.

10. An apparatus according to claim 9, wherein the selectively deformable profile of said vessel side walls has at least one inflexion point.

11. An apparatus according to claim 9, wherein the profile of said vessel side walls may be selectively concavely deformed.

12. An apparatus according to claim 9, wherein the profile of said vessel side walls may be selectively convexly deformed.

13. An apparatus according to claim 1, wherein said conical shield means has a selectively deformable profile.

14. An apparatus according to claim 13, wherein the selectively deformable profile of said conical shield means has at least one inflexion point.

15. An apparatus according to claim 13, wherein the profile of said conical shield means may be selectively concavely deformed.

16. An apparatus according to claim 13, wherein the profile of said conical shield means may be selectively convexly deformed.

17. An apparatus according to claim 1, further comprising a restraining means disposed at the downstream outlet end opening of the vessel for selectively restraining the discharging of material therefrom.

18. An apparatus according to claim 17, wherein the restraining means comprises a skirt provided in the annular discharge passage.

19. An apparatus according to claim 17, wherein the restraining means comprises at least one annular rotary extension member disposed at the vessel downstream outlet opening, and means for driving said rotary extension member for rotation.

20. An apparatus according to claim 19, wherein the rotary extension member comprises an annular crown provided internally with at least one helicoidal vane, the direction of rotation said annular crown and the pitch of said at least one internal helicoidal vane thereof being adapted for discharging solid fractions of said heterogenous mixture through said annular discharge opening without compressing said solid fractions.

21. An apparatus according to claim 1, wherein the vessel is provided internally with longitudinal ribs.

22. An apparatus according to claim 1, wherein the shield means is of the filtering type, being perforated with passages for enabling the escape and separation therethrough of liquid fractions of the heterogenous mixture present at the downstream outlet end opening of the vessel.

23. An apparatus according to claim 1, wherein the vessel and shield means have polygonal cross-sections.

24. An apparatus according to claim 1, wherein the vessel and shield means have circular cross-sections.

25. An apparatus as claimed in claim 1 wherein said shield comprises;

a solid fraction evacuator means disposed in the open downstream outlet end of the vessel and coaxially with respect to the longitudinal axis of the vessel for evacuating solid fractions of said heterogenous mixture from said downstream outlet end of said vessel, said solid fraction evacuator means comprising an evacuator screw having a diameter which increases from an upstream portion thereof towards a downstream portion thereof, said solid fraction evacuator means further including means for imparting a relative rotational movement between said evacuator screw and said vessel.

26. An apparatus according to claim 25, wherein said evacuator screw has a sharp outer edge thereon.

* * * * *